US005285614A

United States Patent [19]

Fouad

[11] Patent Number: 5,285,614

[45] Date of Patent: Feb. 15, 1994

[54] CONCRETE POLE SPLICE

[75] Inventor: Fouad H. Fouad, Birmingham, Ala.

[73] Assignee: Sherman Utility Structures, Inc., Birmingham, Ala.

[21] Appl. No.: 915,006

[22] Filed: Jul. 16, 1992

[51] Int. Cl.[5] ..... E04C 3/30

[52] U.S. Cl. ..... 52/726.4; 52/722; 52/726.1; 425/425; 403/311

[58] Field of Search ..... 52/726.1, 726.2, 726.3, 52/726.4, 722; 403/310, 311; 425/425

[56] References Cited

U.S. PATENT DOCUMENTS

| | | | |
|---|---|---|---|
| 3,345,031 | 10/1967 | Fell et al. | 425/425 |
| 3,936,206 | 2/1976 | Meisberger | 403/334 |
| 4,033,080 | 7/1977 | Fukushima | 52/223 R |
| 4,604,003 | 8/1986 | Francoeur et al. | 405/256 |
| 4,751,804 | 6/1988 | Cazaly | 52/722 |
| 5,012,622 | 5/1991 | Sato et al. | 52/725 |

*Primary Examiner*—Carl D. Friedman
*Assistant Examiner*—Matthew E. Leno
*Attorney, Agent, or Firm*—J. David Pugh

[57] ABSTRACT

The present invention relates to a device for joining concrete pole sections. The joining or splicing device is a tapered sleeve which is cast integrally with an upper concrete pole section and placed over a lower pole section which is tapered to receive the sleeve. The wedging action of the tapered sleeve and pole and the gravity load of the upper pole section establish a tight connection between the sections sufficient to transfer loads imposed on the pole structure.

12 Claims, 3 Drawing Sheets

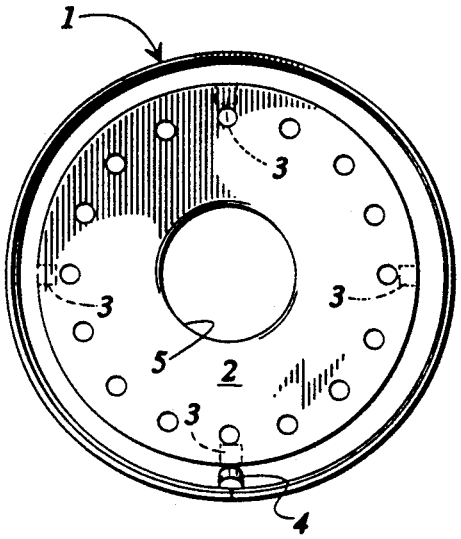
FIG 2
FIG 3
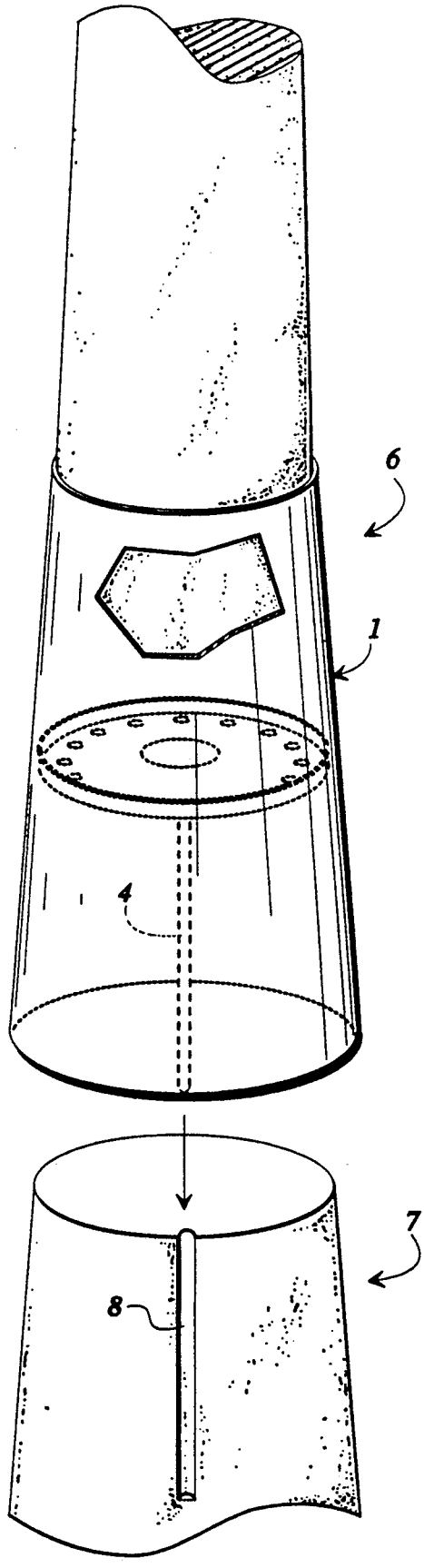

CONCRETE POLE SPLICE

BRIEF SUMMARY OF THE INVENTION

1. Field of the Invention

This invention relates to concrete pole structures used for supporting transmission and distribution lines, lighting and communication systems, highway signs, traffic signals and the like. More specifically, this invention relates to a new and useful device for splicing sections of such concrete pole structures.

2. Background of the Invention

Concrete is the material of choice for pole structures. It is superior to wood or steel because concrete is highly durable, economical and environmentally safe. The longer length of pole required, the greater the superiority of concrete poles. Wood poles are not readily available in longer lengths due to controlled logging operations brought about primarily because of environmental protection concerns. Because of the general unavailability of longer length wood poles, wood pole prices increase substantially once the length exceeds 60 feet. Additionally, wood is a structurally unpredictable material due to inherent, naturally-occurring weak points in the wood. Also, wood poles are subject to ground decay, insect and bird attack. The chemicals used to treat wood poles as a preventative for decay and insect attack pose an environmental hazard.

On the other hand, the production of steel poles is highly labor intensive resulting in greater cost. Steel poles, just like wood poles, require almost constant maintenance, unlike concrete poles.

Concrete, therefore, is the material of choice because of economic and durability concerns. However, the unit weight of concrete becomes an important consideration for pole structures as the required length increases due to difficulties in transporting and erecting such poles.

The present invention solves the transportation and erection problems presented by concrete poles by allowing one to transport the pole in sections from the manufacturing site to the erection site. Once at the erection site, the sections are quickly and efficiently spliced in a permanent connection. The ability to erect such poles in sections is especially important for congested and inaccessible construction sites.

The present invention offers several improvements over the known methods for splicing poles. The significantly lighter pole sections allow the use of fewer personnel and smaller cranes and erection equipment resulting in safer, faster and more economical construction in the field.

2. Description of the Prior Art

There are various known devices for splicing pole sections, whether such sections be made of wood, metal or concrete. Most often, the prior art devices are used to splice an upper wood pole section to a lower metal or concrete section which replaces the lower original wooden section which has deteriorated or decayed because of wheather, insect or bird attack.

Typically, in the prior art devices, a cylindrical sleeve splice is affixed to the top of the lower replacement pole section and the upper original pole section is received in the top of the cylindrical sleeve splice. A binding agent, such as grout, or a mechanical connection, such as a threaded push plate, is required to assure that the upper pole section remains anchored in the splice. Also, because the top end of the splice which receives the upper pole section is open to the elements, a sealant must be used to prevent decay or other weather contamination. Devices of this type are represented by U.S. Pat. Nos. 4,033,080, 4,092,079 and 3,911,548. Other methods for splicing poles in the prior art are disclosed in U.S. Pat. Nos. 4,388,787, 3,713,262 and 3,104,532.

STATEMENT OF THE INVENTION

The present invention consists of a metal sleeve splice which is tapered, having a larger diameter at the bottom than at the top. The splice has an annular baffle plate transversely positioned and secured to the interior wall of the sleeve. The sleeve is placed in a mold during concrete pole production and is spun cast integrally with the upper pole section. The baffle plate, typically located at approximately mid-length of the sleeve, may have holes formed to receive the prestressing strands (if such are used in the upper pole section) and a center hole to provide a continuous hollow core in the pole section. The baffle plate also acts as a barrier preventing the fresh concrete from filling the lower part of the sleeve during pole production.

The part of the metal sleeve splice which extends below the baffle plate forms a tapered socket which slips over the top of a lower pole section. The gravity load of the upper pole section and the wedging action of the tapered lower pole and sleeve establish a tight fit between the two sections. The natural wedging action obviates the need to use a binding agent (such as grout) or a mechanical connection (such as through-bolts or push plates) as required in the prior art devices. A lubricant, such as grease, may be employed to ensure complete engagement between the sleeve and the top of the lower pole section, although the use of such lubricant is not absolutely necessary. If, for any reason, it is desired to connect the sections while they are positioned horizontally, a hydraulic jacking mechanism may be used to pull the sections together. Also, the metal sleeve may be painted or galvanized to prevent corrosion.

Loads imposed on the pole are transferred from the upper pole section to the sleeve through wedging action and bonding of the concrete to the sleeve and, below the baffle plate, through bearing on the top of the lower section and friction or wedging action between the sleeve and the lower pole section. In the upper pole section, fins, tabs or other deformations may be attached to the inside of the sleeve wall before the pole is cast to enhance bonding of the concrete to the sleeve.

To maximize load transfer between the sleeve and the lower pole section, the top portion of the lower pole section may be post-tensioned using high strength steel strands. The post-tensioning will help prevent spalling of the concrete at the top edge of the lower pole section. The post-tensioned strands are anchored at the top of the lower pole section using a steel anchor plate, or plates, which bear on the end of the pole and, at the other end, are embedded in the concrete wall of the pole and transfer loads through bonding with the concrete. The top of the lower pole section may be reinforced more heavily and the concrete wall thickened to handle the additional stresses induced by the post-tensioning.

Accordingly, one object of this invention is to provide a faster and more economical means for joining concrete pole sections and erecting them in the field.

Another object of this invention is to allow installation of concrete pole sections using lighter, standard equipment readily available to contractors obviating the need for special equipment required for handling long, heavy, one-piece pole structures.

Still another object of this invention is to allow easier handling, transporting and erection of concrete poles in congested or inaccessible construction sites.

Still another object of this invention is to provide concrete poles of lengths longer than standard one-piece manufacturing practice allows.

Still another object of this invention is to render the segmented pole construction concept the preferred construction method for concrete poles in a variety of applications.

BRIEF DESCRIPTION OF DRAWINGS

The foregoing and other objects and advantages of the present invention will be apparent from the accompanying drawings viewed in conjunction with the following detailed description of a preferred embodiment of the present invention.

With regard to the accompanying drawings.

FIG. 2 is an end view of the concrete pole splice.

FIG. 3 is an illustration of the proposed erection method of two concrete pole sections using the concrete pole splice.

DETAILED DESCRIPTION OF THE DRAWINGS

Figure 1:
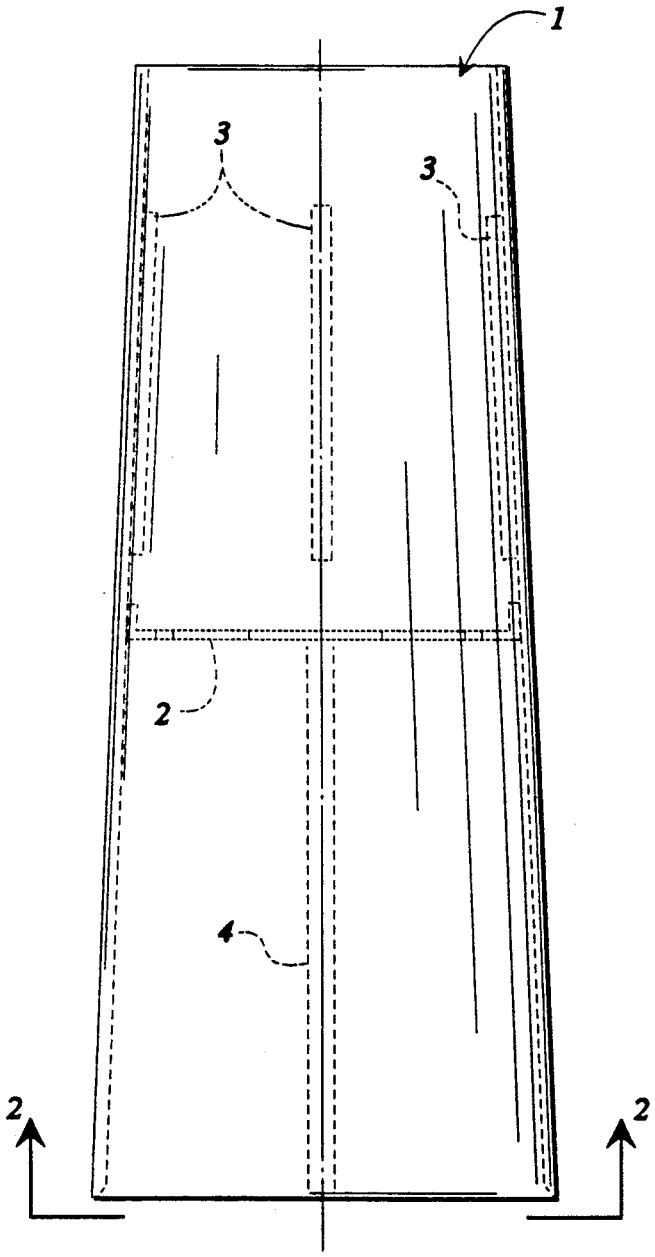
FIG. 1 is a side view of the concrete pole splice.

FIG. 1 illustrates a preferred embodiment of the present invention which consists of a metal sleeve 1 for splicing pole sections. The preferred embodiment shown in FIG. 1 depicts a tapered cylindrical sleeve splice. A variety of shapes could be used as long as the sleeve splice conforms to the shape of the concrete pole section and is cast integrally with the upper pole section. A preferred embodiment is spun cast using a centrifugal casting process, although a form could be prepared for conventional static casting of the concrete pole section. Also, whatever shape is used, it must be tapered having a larger perimeter or circumference at the bottom of the sleeve splice than at the top so as to facilitate the wedging action between the pole sections and the sleeve splice.

For the preferred embodiment depicted in FIG. 1, the constant slope of the tapered sleeve 1 is apparent. This shape conforms to the shape of the concrete pole sections which are similarly tapered, and the upper pole section is actually cast with the sleeve splice to form an integral unit.

Also shown in FIG. 1 is a baffle plate 2 transversely affixed to the interior of the sleeve splice 1 at approximately mid-length of the sleeve splice 1. The baffle plate 2 serves as an anchor plate for prestressing strands in the upper pole section, if such strands are used. The baffle plate 2 also prevents fresh concrete from flowing into the lower part of the sleeve 1 during pole production.

A plurality of fins 3 may be longitudinally affixed to the upper part of the sleeve 1. The fins 3 enhance the bonding of the fresh concrete to the sleeve 1 and help resist torsional loads on the pole. In a preferred embodiment, such fins might be half-inch square steel rods welded longitudinally to the inside of the sleeve splice 1.

In the lower part of the sleeve 1, a guide 4 is longitudinally affixed to the inside wall of the sleeve. The guide 4 allows the upper pole section to be aligned properly with the lower pole section during erection or other means. Proper alignment is necessary because both the sleeve and the pole sections may contain threaded embeds for the installation of climbing steps or other fixtures for which proper alignment is critical. The guide, which may be a half-inch, half-round welded to the sleeve wall, also helps resist torsional loads on the pole.

FIG. 2 is an end view of the sleeve 1 from the bottom of the sleeve. The baffle plate 2 is shown with pre-cut openings for prestressing strands. Also depicted is an opening 5 in the center of the baffle plate providing access for wiring for lights or signage to be supported by the pole structure. A suggested orientation of the fins 3 and guide 4 is also depicted, although the number and orientation of fins and guides may be different in different applications.

FIG. 3 depicts the erection procedure for the concrete pole sections. A crane lowers the upper pole section 6 onto the lower pole section 7 which has been previously anchored in the ground or onto another lower pole section. The guide 4 is manually aligned with a groove 8 which has been cast into the top of the lower pole section 7. Once released, the weight of the upper pole section 6 causes it to settle onto the lower pole section 7 establishing a snug fit through the wedging action of the tapered sleeve splice 1 and the tapered lower pole section 7. A lubricant, such as grease, may be used at the top of the lower pole section 7 to ensure a snug fit.

Figure 4:
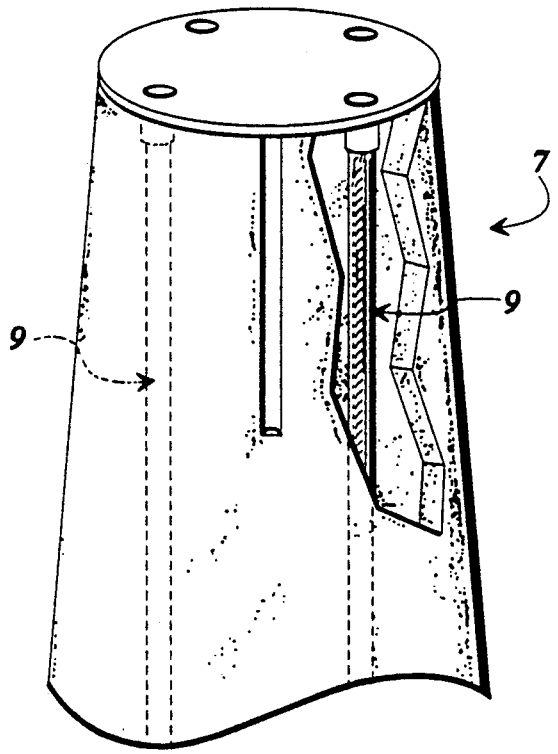
FIG. 4 is a side view of a lower pole section showing the orientation of post-tensioning strands.

FIG. 4 is a section view of the top of a lower pole section 7 depicting the use of post-tensioning strands. The use of such strands 9, although not absolutely necessary, helps prevent spalling of the concrete at the top edge of the lower pole section 7.

What is claimed is:

1. A segmented concrete pole in which an upper pole section is centrifugally cast integrally with a tapered sleeve and placed over a lower pole section, at least the top end of which is tapered to receive the sleeve.

2. A segmented concrete pole as in claim 1 wherein said tapered sleeve is metal.

3. A segmented concrete pole as in claim 1 wherein the tapered sleeve has a baffle plate transversely affixed to the inside of the sleeve.

4. A segmented concrete pole as in claim 1 wherein the tapered sleeve has at least one fin longitudinally affixed to the inside of the sleeve.

5. A segmented concrete pole as in claim 1 wherein the tapered sleeve has at least one guide longitudinally affixed to the inside of the sleeve.

6. A segmented concrete pole in which an upper pole section is centrifugally cast integrally with a tapered metal sleeve, said sleeve having a baffle plate transversely affixed to the inside of the sleeve, which upper pole section and sleeve are placed over a lower pole section, at least the top end of which is tapered to receive the sleeve.

7. A segmented concrete pole as in claim 6 wherein the tapered metal sleeve has at least one fin longitudinally affixed to the inside of the sleeve.

8. A segmented concrete pole as in claim 6 wherein the tapered metal sleeve has at least one guide longitudinally affixed to the the inside of the sleeve.

9. A segmented concrete pole as in claim 7 wherein the tapered metal sleeve has at least one guide longitudinally affixed to the inside of the sleeve.

10. A segmented concrete pole as in claim 1 wherein at least the top end of said lower pole section is reinforced to prevent spalling of the top edge of the lower pole section.

11. A segmented concrete pole as in claim 10 wherein said reinforcing is post-tensioned strands.

12. A method for assembling a segmented concrete pole comprising: centrifugally casting an upper concrete pole integrally with a tapered sleeve; and, placing the upper concrete pole section and sleeve over a lower concrete pole section, at least the top end of which is tapered to receive the sleeve.

* * * * *